United States Patent [19]

Calderon

[11] 4,213,827

[45] * Jul. 22, 1980

[54] METHOD AND APPARATUS FOR QUENCHING COKE

[76] Inventor: Albert Calderon, 1065 Melrose, Bowling Green, Ohio 43402

[ * ] Notice: The portion of the term of this patent subsequent to Jul. 22, 1997, has been disclaimed.

[21] Appl. No.: 757,074

[22] Filed: Jan. 5, 1977

[51] Int. Cl.[2] ..... C10B 33/00; C10B 39/04; C10B 39/14

[52] U.S. Cl. ..... 201/39; 202/227; 202/228; 202/253; 202/263

[58] Field of Search ..... 201/39; 202/227, 228, 202/253, 95, 263; 110/171; 432/85; 266/46, 259

[56] References Cited

U.S. PATENT DOCUMENTS

| | | | |
|---|---|---|---|
| 755,154 | 3/1904 | Moore | 202/227 |
| 982,590 | 1/1911 | Goodall | 202/227 |
| 2,795,539 | 6/1957 | Hughes | 202/228 |
| 3,431,180 | 3/1969 | Neubaum | 201/39 |
| 3,536,592 | 10/1970 | Scharbrough et al. | 201/39 |
| 3,748,235 | 7/1973 | Pries | 202/263 |
| 3,766,018 | 10/1973 | Riechert | 202/227 |
| 3,772,155 | 11/1973 | Knappstein et al. | 202/227 |
| 3,809,619 | 5/1974 | Drebes et al. | 201/39 |
| 3,809,622 | 5/1974 | Knappstein et al. | 202/263 |
| 3,843,461 | 10/1974 | Allen | 202/227 |
| 3,869,352 | 3/1975 | Allen et al. | 202/227 |
| 3,896,556 | 7/1975 | Welter | 201/39 |
| 3,966,563 | 6/1976 | Armour et al. | 202/263 |
| 3,972,780 | 8/1976 | Calderon | 202/227 |
| 3,984,289 | 10/1976 | Sustarsic et al. | 202/263 |
| 4,053,366 | 10/1977 | Holter | 202/263 |
| 4,142,942 | 3/1979 | Calderon | 201/39 |

FOREIGN PATENT DOCUMENTS 875039 4/1953 Fed. Rep. of Germany .

*Primary Examiner*—Bradley R. Garris

[57] ABSTRACT

A method and apparatus for quenching coke which obviates the necessity of using a high energy scrubber for the cleaning of the gases by virtue of quenching the coke in a non-oxidizing atmosphere to drop the temperature of the coke below its ignition point for eliminating the emissions of hydrocarbons, confining the steam and vapor for additional quenching and pressure buildup, cleaning of the steam and vapor of particulate matter, and containing the excess quench water including the breeze resulting from the quench.

5 Claims, 11 Drawing Figures

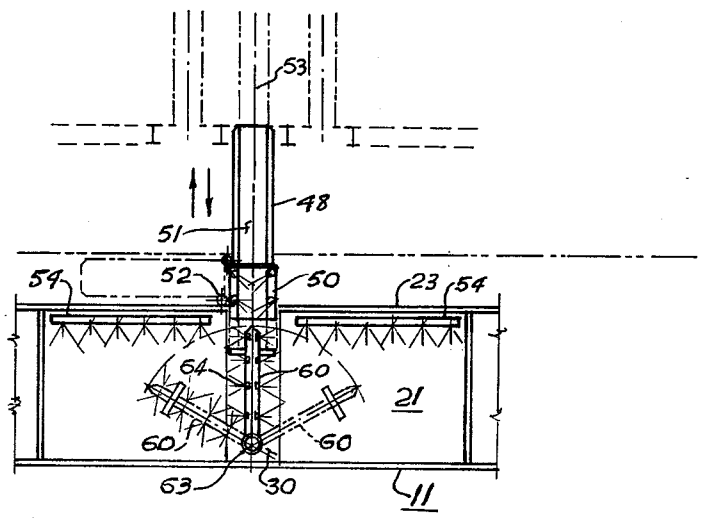
FIG. 3
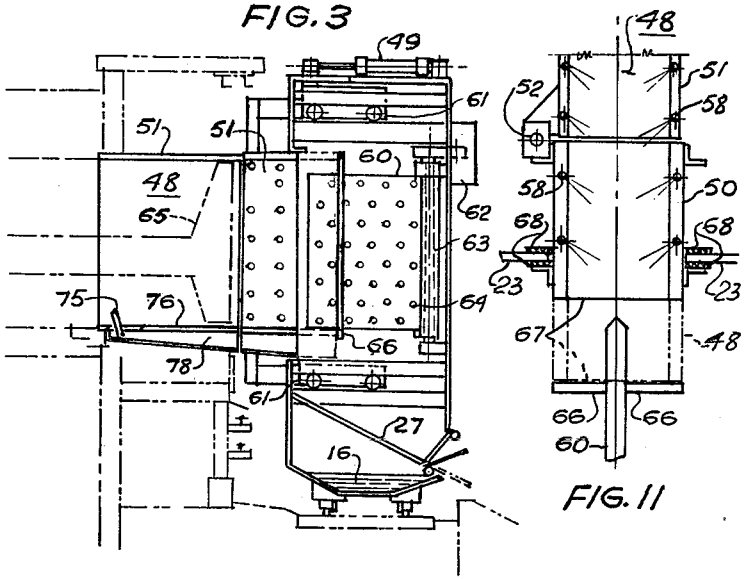
FIG. 11
FIG. 10
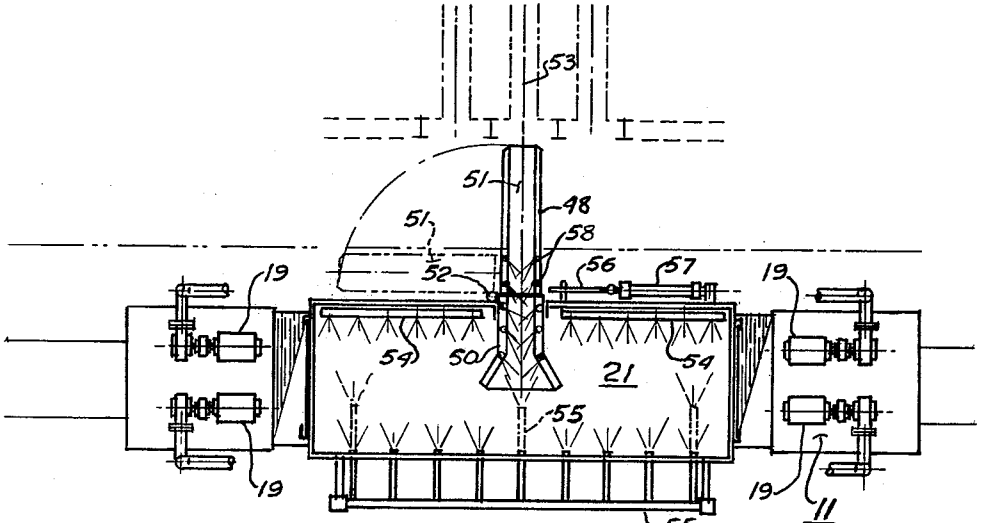
FIG. 2
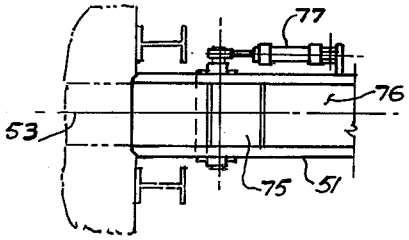
FIG. 9
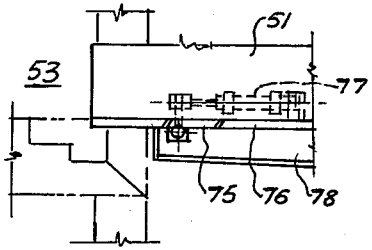
FIG. 8
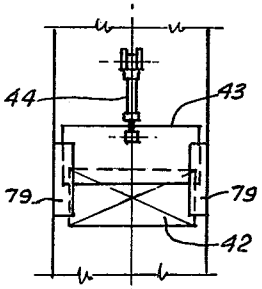
FIG. 7

METHOD AND APPARATUS FOR QUENCHING COKE

The present invention relates to the controlling of emissions during the pushing and quenching of coke. Various schemes have been presented and tried to control the emissions from the push such as a one-spot car which is enclosed and connected to a dust collection system such as a high energy scrubber car. After the push, both the quench car and the scrubber car are driven to a quenching station and the temperature of the coke is dropped by quenching with water. But in particular, this invention relates to an improvement over the patent issued on Mar. 20, 1973 to Swindeler and numbered U.S. Pat. No. 3,721,609 which discloses a quenching car having a vertical fall space into which the coke is pushed from a guide and this fall space offering greater surface area to quench the coke in place and obviating the necessity of going to a quenching station. This patent also discloses the washing of the steam and vapor to remove particulate matter.

At the present time the United States operates about 230 coke oven batteries, most of which are of the 4-meter size; there are about 20 batteries of the 6-meter size. All these batteries possess a coke side bench which is above ground level on which an oven-door extractor runs. At ground level a standard gauge track is disposed for a conventional quenching car. With the pressure applied from EPA to contain emissions during the push, it is of paramount importance to be able to retro-fit the existing batteries wherein the dimensions range from nine to twelve feet from the oven floor to said track at ground level in the case of the 4-meter batteries and from fifteen to nineteen feet from the floor to said track in the case of the 6-meter batteries. The distance between the supporting structure of the bench and wharf into which the quenching car discharges its coke after being quenched, is just enough to permit the running of equipment not exceeding the width of conventional quenching cars which average from ten to thirteen feet. The above-mentioned patent of Swindeler cannot fit within the confines of existing space from the standpoint of height and from the standpoint of width since Swindeler's quenching car necessitates great amounts of height to obtain the fall and a broad guage track to run on. To excavate and do civil engineering for providing the dimensions needed by Swindeler, would completely disrupt operations.

The reason for companies placing orders for the one-spot car equipped with a scrubber and not the quenching car proposed by Swindeler is because the one-spot car can be retro-fitted within existing clearances. However, the one-spot car mentioned besides needing a high energy scrubber, will require a diesel electric engine for the power generation and use oil for fuel. The noise and the oil-burning diesel are objections because they are new sources of pollution as well as add-on operating costs. Also there are signs that the quenching tower has an emission problem in itself which the one-spot car above-mentioned does not solve.

Other improvements of the instant invention over Swindeler's and the one-spot car equipped with a scrubber will become apparent further in the specification. These improvements pertain to the handling of the excess quench water, the breeze generated during the quench, control of the steam and vapor, the prevention of the water to clean the steam from over quenching the coke, the more efficient method of dropping the temperature of the coke and the efficient method of cleaning the steam and vapor.

Since the emissions generated during the pushing and quenching of coke are substantially two kinds; namely, hydrocarbons and particulate matter, it is the main object of this invention to provide an improved method and apparatus which will control both the hydrocarbons and the particulate matter by dropping the temperature of the coke below its ignition point in an enclosed chamber and in the absence of oxygen and cleaning the steam generated by the quench to precipitate the particulate matter in the steam and vapor without the employment of high energy scrubbing means which require an excessive amount of energy to operate, and at the same time making possible the retro-fitting of such method and apparatus in existing facilities without the interruption of productivity and without excessive power consumption.

Another object of this invention is to provide a confinement of the steam and vapor so that it can be directed to a controlled exit in order to direct it to a throat means so that the cleaning of the steam and vapor is efficiently carried out without the necessity of a fan.

Still, an object of this invention is to quench the coke in an enclosed chamber and confine the steam and vapor so generated therein in order to build a positive pressure within said chamber and thereby permeate the coke with steam and vapor to further drop the temperature of the coke.

Further, an object of this invention is to provide a self contained quenching means in which the coke is quenched in a sealed chamber and the steam and vapor is cleaned in adjacent chamber means so that particulate matter in the steam and vapor is collected in a separate area than where the quenched coke is contained.

Yet, an object of this invention is to provide a means having storage means at the bottom thereof for the collection of excess water and particulate matter such as breeze washed from the coke during the quenching thereof, adapted to collect such excess water and breeze without the possibility of causing interferences to a steady operation, the generation of breeze being an inherent factor in coke making.

Further yet, an object of this invention is to provide quenching means having an enclosed chamber into which coke is pushed wherein said chamber has the capacity of containing a pool of water in order to float and submerge the coke, said chamber being equipped with control gates in order to retain said pool and selectively discharge it into said excess water storge means.

Still, another object of this invention is to provide water make-up means to maintain a constant level of said pool within said chamber.

Still further, another object of this invention is to provide spraying means within said chamber in the form of spears adapted to penetrate the coke for efficient cooling of said cake, said spears being fixed or moveable.

It is further another object of this invention to provide a swinging-blade means within said chamber to spread the coke as it is pushed into said chamber in order to distribute said coke within said chamber, said swinging-blade being equipped with water sprays in order to spray the coke and simultaneously to spread it so that the coke is quenched in layers with maximum surface exposure.

Therefore, another object of this invention is to provide a guide means equipped with sprays in order to abate smoke while the coke is in the guide and to direct the sprays towards the direction of the push in order to create a negative draft within said guide and at the same time clear the guide of coke in the area where the ram of the pusher has no access after the completion of the push.

Further, another object of this invention is to make said guide to bifurcate and project within said chamber, said guide being equipped with sprays directed towards the direction of the push in order to provide the maximum surface coverage and also move the coke within said guide with the aid of water pressure in the areas not accessible to the ram of the pusher.

It is still further, another object of this invention to make the guide part of said quenching means and provide said guide with articulated features in order to swing towards the oven to be pushed and fold away from the oven after the push, such swinging guide making possible the relieving of the load on the coke side bench and also liberating the door-extractor during the push.

It is further yet, another object of this invention to provide a self-contained car for the pushing and quenching of coke which is retro-fitted to existing conditions of the coke side of conventional batteries and having a carriage to make it moveable from point to point, an enclosed guide which is adapted to swing and move towards the oven to be pushed, a quenching chamber having sloped bottoms equipped with discharge gates, excess water diverting-plates which are rotatable co-acting with said gates and stack means for discharging the steam and vapor after being cleaned, and wherein said guide means interconnects the oven to be pushed to said chamber, water storage means equipped with pumps to furnish water under pressure, means to spread the coke within said chamber and at the same time spray the coke to drop the temperature thereof below its ignition point, and means to contain excess quench water, said chamber having outlet means for discharging the steam and vapor generated from the cooling of the coke, means for controlling the said outlets, and means to clean said steam and vapor emerging from said outlet means before ejection above the battery.

Other objects of this invention will appear from the following detailed description and appended claims.

Reference is made to the accompanying drawings forming a part of this specification wherein like reference characters designate corresponding parts in the views.

BRIEF DESCRIPTION OF DRAWINGS

FIG. 2 is a plan view of the invention using the principle of flooding and spear cooling.

FIG. 3 is a partial plan view of the invention showing the articulated guide and the swinging-blade for coke spreading.

FIG. 7 is a section view at 7—7 of FIG. 1.

FIG. 8 is a partial side view of an arrangement for the water control by-pass to prevent water from entering the oven from the guide.

FIG. 9 is a plan view of FIG. 8.

FIG. 10 is a sectional end view of the oven shown in phantom and of the invention teaching the principle of the swinging-blade for the distribution of the coke.

FIG. 11 is a partial top view showing one way of sealing the moveable guide to the chamber into which the coke is pushed.

Before explaining in detail the present invention, it is to be understood that the invention is not limited to its application and to the details of construction and arrangement of the parts illustrated in the accompanying drawings since the invention is capable of other embodiments. Also, it is to be understood that the phraseology or terminology herein is for the purpose of description and not limitation.

DETAILED DESCRIPTION OF DRAWINGS

Figure 1:
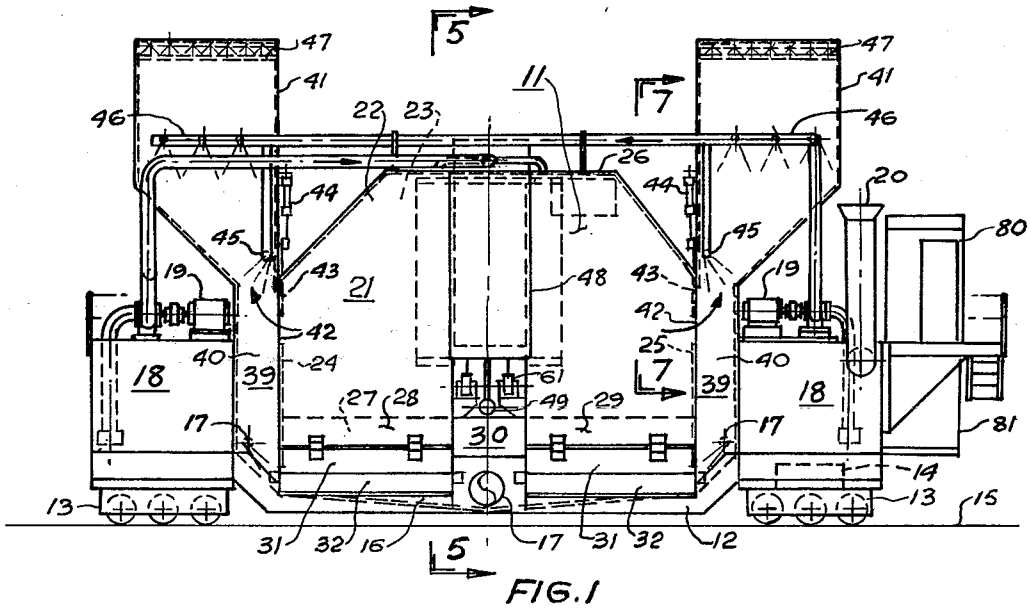
FIG. 1 is a front elevation of the invention.

In the drawings and referring to FIG. 1, 11 indicates the improved coke quenching car. It possesses base 12 mounted on wheeled trucks 13 which are adapted to run on rails 15 driven by motor 14 in order to form a moveable carriage. Base 12 is made of longitudinal girders with the space in between occupied by excess water tank 16. Excess water tank 16 is made with a sloped bottom towards the center of base 12 for drainage purposes and valve 17 is disposed in order to empty the excess water, the breeze and the precipitated particulate matter. In order to prevent the settling of breeze and particulate matter in tank 16 flushing jets 17 adapted to spray water under pressure are used during the emptying of tank 16.

Rising from base 12 water tanks 18 are disposed over trucks 13 in order to stabilize the weight of car 11. Pumps 19 are mounted on tanks 18 in order to distribute water to the various sprays located in the components of car 11. Standpipe 20 is made an integral part of tank 18 for the filling thereof and both tanks are inter-connected so that the level of the water of both tanks is maintained at the same level.

Figure 4:
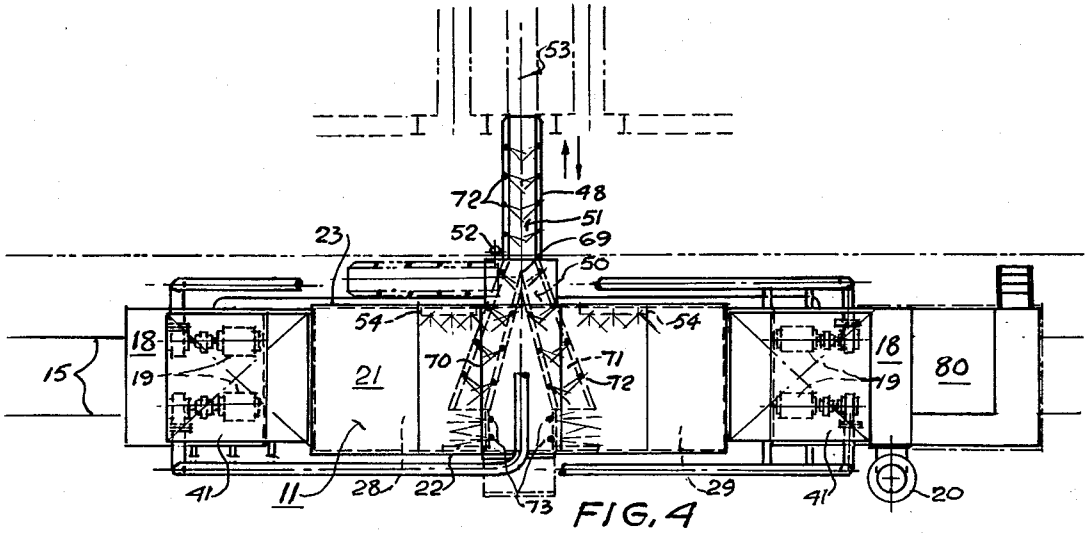
FIG. 4 is a plan view of the invention using the afticulated guide attached to a biforcated section.
Figure 6:
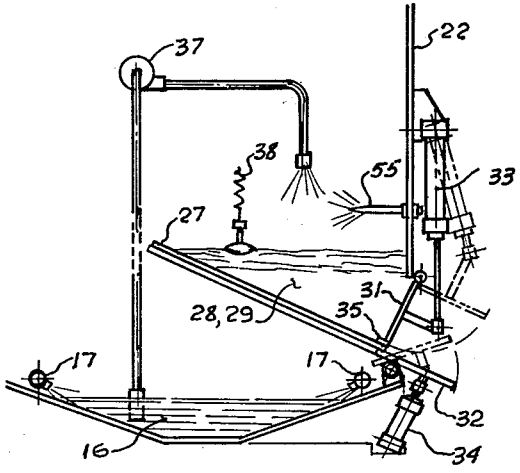
FIG. 6 is a schematic view showing the water pool contained within said chamber and the excess water storage with a make-up pump.
Figure 5:
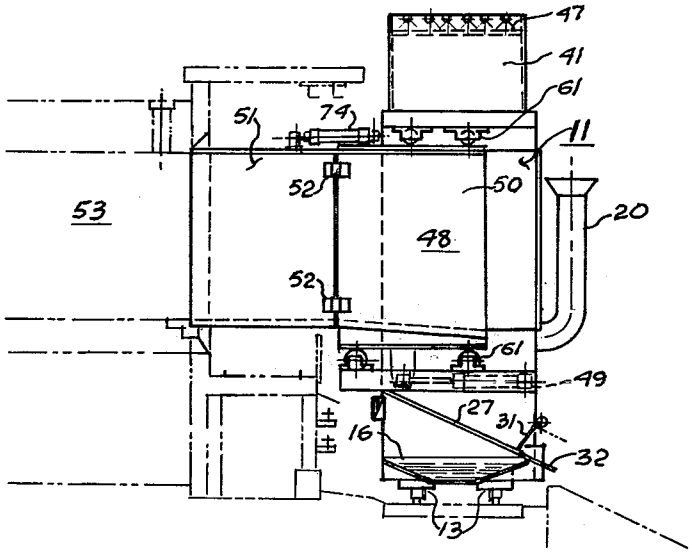
FIG. 5 is a sectional side view of FIG. 1 taken at 5—5 of FIG. 1.

A steam chamber denoted by numeral 21 extends preferably from the center line of base 12 towards tanks 18 to form an enclosure for the reception of the coke. Chamber 21 is made up of longitudinal side 22 which is away from the battery and side 23 which is towards the battery. Sides 22 and 23 are bridged by ends 24 and 25. A top 26 closes the upper part of chamber 21 and inclined bottom 27 closes the bottom of chamber 21. Preferably bottom 27 is divided into two sections 28 and 29 and separated by central structure 30. Sections 28 and 29 are equipped with gates 31. As shown in detail in FIGS. 1 and 6, gates 31 are operated by actuating means 33 and flappers 32 operated by actuating means 34, direct the excess water from bottom 27 to tank 16. In the feeding of the coke onto the wharf after the completion of the quenching operation, gates 31 open to the dotted position and flappers 32 to the solid position as shown by FIG. 6 in order to provide a continuous inclined plane for the sliding of the coke from quenching car 11. Gate 31 is equipped with seal 35 around its periphery for sealing sections 28 and 29 and make them water tight. And in the event of warpage or abuse and the desirability of maintaining pool 36 in sections 28 and 29, make-up pump 37 is furnished controlled by float 38. Preferably two narrow spaces denoted by numeral 39 are provided at each end of chamber 21 which spaces are bordered between tanks 18 and ends 24 and 25. Within each space 39 vertical duct 40 rises upwardly and enlarges in size to form a steam and vapor stack 41. Steam and vapor is directed from chamber 21 into each stack 41 through outlets 42, and dampers 43 control the opening of outlets 42 by means of actuators 44. Within stack 41 water jets 45 are disposed at the throat of duct 40 in order to wash the steam and vapor as they emerge through outlets 42. By controlling the opening of outlets 42 the pressure within chamber 21 is maintained so that the escaping steam and vapor are ejected without the necessity of having fans and yet provide efficient gas cleaning means. Additional sprays are indicated by numerals 46. On top of stacks 41 de-misters 47 equipped with water sprays are furnished for additional precipitation of particulate matter. Above central structure 30 guide 48 shown on FIGS. 1, 2, 3, 4, 5 and 10 is provided and is equipped with actuating means 49 in order to move the guide towards and away from the oven to be pushed. Preferably guide 48 is made up of two sections 50 and 51. Section 51 being adapted to articulate, preferably 90°, towards the ovens for pushing and towards quenching car 11 when quenching car 11 travels to discharge and take water or to dump the coke onto the wharf. The method of quenching by means of the instant invention may take one of several embodiments or a combination of parts of such embodiments and by way of example FIGS. 2, 3 and 4 show various embodiments. In FIG. 2 coke guide 48 which is made up of sections 50 and 51, interconnects the oven to be pushed shown by numeral 53, to chamber 21 to receive the coke from oven 53. Chamber 21 is equipped with sprays 54 which have the capacity to flood chamber 21 with water supplied by pumps 19. Sprays 55 in the form of spears located above gates 31 can be added to penetrate through the coke for coolant distribution. As shown in FIG. 6, pool 36 can also be formed before the push to minimize the flooding and reduce the horsepower of pump 19. After the quench and the retraction of the ram from guide 48, gate 56 closed by actuator 57 is employed to seal chamber 21 subsequent to the articulation of section 51 towards quenching car 11. Sprays 58 which are directed towards the direction of the push of the coke serve to create a negative draft within the guide at the beginning of the push and prevent smoke from escaping and also empty the guide of residual coke at the end of the push from areas not accessible to the ram of the pusher which pusher is not shown.

Referring to FIGS. 3, 10 and 11, sections 28 and 29 of car 11 receive the coke from guide 48 which is against oven 53. Guide 48 is divided into two parts, the straight part 50 and the articulated part 51, articulated part 51 being shown in solid against the oven and in phantom in the folded position. Actuator 59 moves guide 48 to and from the oven and section 51 thereof swings about pivot 52. Guide 48 is supported by carriage means 61 for proper support of guide 48. Sections 28 and 29 are preferably separated by central portion 30 and swinging blade 60 operated by means 62, such as a crank, to impart an oscillating motion about pivot 63 to swinging blade 60 and thereby spread the coke into sections 28 and 29. It is preferred to have blade 60 equipped with built-in water sprays such as spray 64 so that the coke being pushed through guide 48 onto central portion 30 is cooled as it is being spread by means of blade 60 and thereby spray the falling coke in layers. It is contemplated to give several oscillatory cycles to blade 60 during the push of the coke in order to lay the coke in layers and maximize the spraying of the layers for the greatest surface exposure to water. Supplementary sprays 54 are furnished over sections 28 and 29 for additional quenching capacity. Sprays 58 in guide 48 are included to cause a negative draft within guide 48 and also clear the end of the guide of coke at the end of the push from the area of the guide not accessible to ram 65 shown in phantom in FIG. 10. In order to prevent steam from escaping from chamber 21, guide 48 is moved against wings 66 of swing blade 60 which close coke discharge opening 67 of guide 48. Seals 68 are mounted on side 23 of chamber 21 in order to prevent steam from escaping between the guide and side wall 23, this being shown by FIG. 11.

Referring to FIG. 4, guide 48 is also made in two sections 50 and 51 in which 50 is the swingable portion and 51 is a biforcated section having wedge 69 to cut the coke substantially at the center thereof and divert it into legs 70 and 71 in order to open up the coke to maximum surface exposure. Sprays 72 are disposed in guide 48 to drop the temperature of the coke as soon as the coke is pushed and also to move the coke by means of pressurized water (hydraulically) in the portion in which the ram of the pusher has no access. It is preferred to have sprays 72 positioned in such a way that the spray pattern is directed towards the direction of the push. The biforcation of guide 48 assisted by pressurized sprays spread as well as cool the coke. Sprays 73 disposed towards wall 22 of quenching car 11 help push the coke after it leaves the guide towards the deep end of sections 28 and 29. Guide 48, shown by FIGS. 4 and 5, moves to and away from oven 53 on carriage 61 and propelled by actuating means 49. Swinging section 51 is effected by means of actuator 74. Auxiliary sprays 54 within chamber 21 are included.

To prevent water from seeping into the oven from guide 48, reference is made to FIGS. 8, 9 and 10, trap door 75 is disposed to bottom 76 at the extremity thereof and as close as possible to oven 53 of guide section 51. Trap door 75 is opened and closed by means of actuator 77. Beneath bottom 76 of guide portion 51, water trough 78 is disposed and is sloped toward car 11 and carries the water from bottom 76 back into car 11.

The controlling of the steam and vapor generated during the quench is accomplished by gate 43 and moved by means of actuator 44 to open or close outlet 42. Gate 43 is guided by means of sideguides 79, this being shown in a partial view in FIG. 7.

Quenching car 11 is equipped with cab 80 for the operator and controls 81 for the operation are housed under cab 80.

While the operation of the apparatus of the present invention may be comprehended from a study of the foregoing description it is believed that the operation may be further explained as hereinafter set forth:

OPERATION

Referring to the drawings, car 11 is driven to a water filling station located somewhere along the battery preferably next to the present quenching sumps and tanks 18 filled with water. Their capacities is good for at least one quench. After the filling, the operator in cab 80 moves car 11 so its transverse center line is opposite oven 53 which is to be pushed. The door extractor, which is not shown and is not part of this invention, extracts the door from oven 53 and articulated section 51 of guide 48 is rotated from its folded position to be in line with oven 53 by means of actuator 74. Guide 48 is then propelled forward against the jamb of oven 53 while rolling on carriage 61, the forward movement being effected by actuator 49. A signal is transmitted from the pusher operator to the quenching car operator in cab 80, that the push is ready to commence.

Since the invention is shown in several embodiments the description of the operation shall proceed by describing the embodiments shown by FIG. 2, FIG. 3 and FIG. 4 by following the numerical order. In describing the embodiment of FIG. 2, upon receipt of the signal from the pusher operator by the operator in cab 80 of quencher car 11, the operator of the quenching car actuates valving means to spray water in guide 48 in order to create a negative draft therein and upon seeing color at the junction of guide 48 against the jamb of oven 53, he turns-on sprays 54 which sprays are of great capacity. He also simultaneously turns sprays 45 at the throats of ducts 40 and sprays 46 in stacks 41. It is to be noted that guide 48 and chamber 21 are completely enclosed to provide a non-oxidizing atmosphere.

As the coke falls into chamber 21 from discharge end of section 50 of guide 48, the coke floats on water and then is partially submerged in the torrent of water supplied by sprays 54. As the temperature of the coke is dropping, great volumes of steam and vapor are generated in chamber 21 and the gases seek the path of least resistance which are outlets 42 leading into ducts 40. Controlling the size of outlets 42 by means of gates 43 dictate the positive pressure developed within chamber 21. At the end of the push, guide 48 is retracted, section 51 is swung to its folding position and gate 56 closes the opened joint between sections 50 and 51 thereby making chamber 21 completely enclosed except for outlets 42. As the steam and vapor leave the chamber through said outlets, powerful water sprays 45 located at the throat of a venturi-like structure wash the steam and vapor to knock down particulate matter in the steam. The water and condensate laden with particulate matter run down space 39 to tank 16 in base 12 of car 11. The steam and vapor are further cooled in stack 41 and are further cleaned by di-mister 47 before ejection to the atmosphere.

The fact that the quenching gets done in an enclosed chamber in the absence of oxygen and the temperature of the coke is dropped below its ignition point, the burning of the coke is prevented and in this manner the emission of hydrocarbons is prevented. The fact that the steam pressure builds up in chamber 21 and the steam and vapor being forced through outlets 42 by the positive pressure developed within chamber 21, the steam and vapor are thusly pushed into ducts 40 without the use of a fan, and at the throat of duct 40, the steam and vapor are washed similar to a venturi scrubber without the necessity of having high-energy fans. In dropping the temperature of the coke below its ignition point and in cleaning the steam and vapor before ejection the two problems of pushing and quenching are solved in one single solution. The excess water from the quench is controlled by movement of doors 31 and flappers 32 so that excess water and the breeze (braze) inherently generated run into tank 16. The dropping of the temperature of the coke can also be done by forming pool 36 contained by wall 22, bottom 27 and gate 31. To control the moisture of the coke, which is a very important factor from the standpoint of blast furnace operation, the pool can be drained selectively so that excess moisture in the coke is eliminated. Further, spraying spears 55 are introduced inside chamber 21 to quench through the coke if minimizing of flooding is desired.

The embodiment shown by FIG. 3, in operation is carried out as follows: Upon receiving a signal from the pusher operator, the operator in cab 80 turns on the water in enclosed guide 48 to create a negative pressure within the guide and initiate the oscillation of swinging blade 60; the turning on of the sprays within blade 60 is preferably automatic. As the coke is pushed into chamber 21 the swinging blade sweeps the coke from the exit end of section 50 of guide 48 and spreads it into either chamber 28 or 29 and simultaneously with this spreading action, the coke is sprayed so that the cooling of the coke is effected in layers, since several oscillatory cycles occur during a single push. To supplement the water sprayed from blade 60, sprays 54 are turned on as needed. Upon the completion of the push, guide 48 by means of actuator 59 is retracted from oven 53, and by means of electrical interlocks known in the art, swinging blade is brought to the center line of guide 48 so that upon withdrawal of guide 48, the exit end of guide 48 is sealed against wings 66 of swinging blade 60. It is preferred to have spraying blade 60 extend vertically an appreciable height so that the wall of coke emerging from the guide is spread to either section 28 or 29 depending upon the direction of the swing of the blade at certain particular moment.

In sealing chamber 21 by the retraction of guide 48 the positive pressure within chamber 21 builds up depending upon the opening of outlets 42. The steam and vapor are cleaned as described above with pressurized water sprayed at a narrow throat similar to a venturi except that no suction is used. In spreading the coke in layers and in simultaneously spraying the layers a maximum surface exposure of the coke is obtained with the result the coke is quenched efficiently and the moisture thereof kept low and uniform and with minimum water consumption.

In the embodiment shown by FIG. 4 before the coke is pushed, sprays 72 and 73 are turned on to create a negative pressure within the guide to prevent smoke from escaping at the joint of guide 48 and the oven, and at the joint between sections 50 and 51 of guide 48. The coke, as it is being pushed, is bisected substantially at the cleavage and in this manner it is exposed to as much surface as possible for quenching in the guide. Sprays 54 are turned on if additional quenching is needed after the coke falls within chamber 21.

During the quenching, the steam and vapor are controlled from outlets 42 and they are cleaned at the venturi-like throats of ducts 40. The pressure developed within chamber 21 provides the energy required for pushing the steam through said throats without the necessity of the employment of high energy fans which require appreciable horsepower to operate.

Having completed the push, sprays 72 located in the biforcated section which is not accessible to the pusher ram, are maintained in order to push the coke into sections 28 and 29 by means of water pressure (hydraulically) and in this fashion substantially empty branches 70 and 71 of section 51 of guide 48. To push the coke away from the discharge ends of branches 70 and 71, sprays 73 operating with pressurized water push the coke away from the center of chamber 21. At the end of the push guide 48 is retracted from the oven by means of actuator 49 and the discharge ends of branch 70 and 71 are sealed against end 22 so that steam is prevented from leaving chamber 21. Section 51 which articulates about pivot 52 is pulled in to fold against side 23 of car 11. If needed, sprays 54 are turned on for additional quenching. During the quenching, and the steam and vapor cleaning, all excess water runs into tank 16 of car 11, and breeze as well as particulate matter, are washed down into tank 16. It is to be noted that the bulk of the weight of car 11 before and after the quench is maintained in the lower part of the car for good stability and the components of the machine are so distributed to give a balanced structure.

At the end of the push the quench continues within chamber 21 by means of water as well as steam since the pressure within chamber 21 is maintained in the positive and in this manner force steam and vapor to permeate in and around the coke. It is preferred to have car 11 discharge the water contained in tank 16 after every push and the bottom of tank 16 scoured by means of jets 17 so that the circulation of water carrying particulate matter is minimized. Therefore in operation, at the end of the push, quench car 11 is driven to the water filling station, not shown, valve 17 opened and tank 16 emptied and scoured, this being done while tanks 18 are being filled with water that has been filtered or strained. Car 11 is then driven to the wharf (not shown), flappers 32 dropped to the position shown by FIGS. 5 and 6 and gates 31 opened so that the quenched coke is discharged onto the wharf.

Towards the end of the push when the ram leaves the oven and enters guide 48, there is a tendency for water to flow towards the oven since the oven becomes the path of least resistance. To avoid water from running into the oven floor, actuator 77 is activated to open trap door 75 to its raised position shown in FIG. 10 and in this manner short circuit the water flow and divert it back into chamber 21 by means of inclined chute 78.

While it is preferred to completely quench the coke before reaching the water filling and dumping station it is also possible to partially quench prior to arrival at the water filling and dumping station and finishing the quench in the area of the filling and dumping station.

It is to be noted that certain variations to the structure shown may be implemented. Such as a swinging blade having a horizontal pivot instead of a vertical one for the distribution of the coke within chamber 21, or the employment of an enclosed guide which does not articulate and fold, such as the guide being used in conjunction with a conventional door extractor. The control of the positive pressure within chamber 21 can be made to vary so as to maximize the quenching of the coke with steam and minimize the amount of water used in order to make a superior coke with low and uniform moisture, and, the venturi effect at the throat can be sized so that the amount of steam and vapor is controlled from outlets 42 in such a manner that an efficient cleaning operation can result without the use of high energy fans.

All in all it is submitted that the method and apparatus for controlling emissions during the pushing and quenching of coke are capable of performing in an efficient manner with a minimum use of energy and at the same time providing dependable availability which the industry urgently needs, and which can be installed without civil engineering so that it can be retro-fitted expediously in existing facilities.

I claim:

1. Apparatus for controlling pollutions during the discharge of coke from a coke oven having a pusher side and a coke discharge opening, said apparatus comprising a carriage movable with respect to the coke oven and selectively positionable with respect to the coke discharge opening, a chamber supported on said carriage, guide means carried by said carriage and selectively positionable in alignment with the coke discharge opening for guiding coke being pushed through the coke discharge opening into said chamber, means for directing liquid at coke which is pushed into said chamber for dropping the temperature of the coke, said chamber being substantially enclosed for confining steam and vapor generated during the dropping of the temperature of the coke and for building and maintaining a positive pressure within said chamber, a venturi-like aperture having an inlet side communicating with said chamber and having an outlet side, the positive pressure developed in said chamber forcing steam and vapors generated from the quenching of said coke through said venturi-like aperture, liquid spraying means disposed for spraying liquid at gases forced through said venturi-like aperture by the positive pressure in said chamber carried by said carriage.

2. Apparatus as defined in claim 1 including means for controlling the size of said venturi-like aperture for controlling the positive pressure in said chamber.

3. Apparatus as defined in claim 1 wherein said guide means is supported by said carriage and is pivotally movable from a retracted position to an operating position in alignment with the coke discharge opening.

4. A method of controlling pollutions during the discharge of coke from a coke oven having a pusher side and a coke discharge opening, said method comprising the steps of moving a carriage into alignment with the coke discharge opening, pushing a body of hot coke out of the discharge opening of the oven, guiding the coke pushed from the oven into a chamber supported on said carriage, quenching the coke by directing liquid at coke which is pushed into said chamber for dropping the temperature of the coke, confining steam and vapor generated during the dropping of the temperature of the coke in the chamber for building a positive pressure within the chamber, forcing the steam and vapors generated from the quenching of the coke out of the chamber through a venturi-like opening by means of the positive pressure built up in the chamber, and spraying liquid at the gases forced through said venturi-like opening by the positive pressure in the chamber for cleaning the gases.

5. A method as defined in claim 4 including the step of controlling the size of the venturi-like opening for controlling the positive pressure in said chamber.

* * * * *